United States Patent [19]

Saad

[11] Patent Number: 4,978,934

[45] Date of Patent: Dec. 18, 1990

[54] SEMI-FLEXIBLE DOUBLE-RIDGE WAVEGUIDE

[75] Inventor: Saad M. Saad, Willowbrook, Ill.

[73] Assignee: Andrew Corportion, Orland Park, Ill.

[21] Appl. No.: 365,598

[22] Filed: Jun. 12, 1989

[51] Int. Cl.[5] ..... H01P 3/14; H01P 3/123

[52] U.S. Cl. ..... 333/241; 29/600

[58] Field of Search ..... 333/239, 241, 242

[56] References Cited

U.S. PATENT DOCUMENTS

| | | | |
|---|---|---|---|
| 3,396,350 | 8/1968 | Krank et al. | 333/241 |
| 3,659,234 | 4/1972 | Schuttloffel et al. | 333/241 |
| 3,822,411 | 7/1974 | Merle | 333/241 |
| 3,945,552 | 3/1976 | Tobita et al. | 228/17.5 |

OTHER PUBLICATIONS

Collado, "An Inside Look at Double-Ridge Guide", Microwaves & Rf, Jul. 1986, pp. 77–79.

Findakly et al., "Attenuation and Cut-off Frequencies of Double-Ridged Waveguides", The Microwave Journal, pp. 49–50.

Raymond Bulley, "Analysis of the Arbitrarily shaped Waveguide by Polynomial Approximation", IEEE Transactions vol. MTT 18, No. 12, Dec., 1970, pp. 1022–1028.

Gabriel Microwave Ltd., Advertisement, "Seamless Flexible & Flexible Twistable Waveguides".

Gabriel Microwave System Ltd., Advertisement, "Gabriel Double Ridge Flexible and Twistable Waveguides".

Continental Microwave & Tool Co., Inc., Advertisement, "Lets Get Flexible with Continental Flex Waveguide".

Litton Airtron, Advertisement, "Double Ridge Flexible-Twistable".

Evered and Company (Metals) Limited, Advertisement, "Azdar Double Ridged Waveguide".

*Primary Examiner*—Paul Gensler

*Attorney, Agent, or Firm*—Kareem M. Irfan

[57] ABSTRACT

A semi-flexible double-ridge waveguide comprises a corrugated tube formed into a special dumbbell-shaped cross-section defined by parameters which are conveniently optimized to realize improved power-handling capability as well as improved attenuation and VSWR factors across extended dominant-mode operational bandwidths. The dumbbell-shaped cross-section efficiently removes the problems typically associated with the use of conventional rigid waveguide, including difficulty of installation as well as the need for precise alignment of components, by combining flexibility and ease of manufacture, even for long lengths of waveguide, through use of a continuous, uncomplicated and relatively inexpensive process.

The dumbbell-shaped cross-section is totally devoid of corners and other abrupt protrusions and is defined by a geometric equation in which specific parameters can be correlatively optiminzed to improve desired electrical properties of the waveguide. The waveguide is rendered "semi-flexible" by the provision of helical corrugations having a staggered disposition of opposing corrugation crests and troughs, whereby the breakdown air gap and, consequently, the maximum power rating is increased.

11 Claims, 10 Drawing Sheets

SEMI-FLEXIBLE DOUBLE-RIDGE WAVEGUIDE

BACKGROUND OF THE INVENTION

1. Field of the Invention

This invention relates generally to waveguide used for transmission of broadband electromagnetic signals. More particularly, this invention relates to corrugated ridged waveguide of the flexible kind which can be processed in long lengths by a continuous process and has improved power-handling capability.

2. Description of the Prior Art

The use of smooth-walled waveguide is extremely common in microwave transmission systems. Waveguide of rectangular cross-section, in particular, is most often employed because it provides satisfactory electrical performance for a number of waveguide applications. Rigid and smooth waveguide, however, is subject to severe restraints, both economic and utility-based, because the non-flexible nature of such waveguide entails manufacturing in relatively short lengths and requires use of customized lengths, bends and twist sections to suit the equipment layout at each site. In many applications, therefore, waveguide which is rendered flexible by provision of corrugations is used. Such waveguide is commercially fabricated by first forming a smooth-walled tube from a tube of conductive metal and thereafter corrugating the tube.

In applications needing bandwidths greater than can be obtained from rectangular waveguide, some form of ridged waveguide, typically double-ridge waveguide, is used. In such ridged waveguide, ridges realize a perturbation of the cross-section which provides broader bandwidth between the cut-off frequency of the dominant-mode and the first higher-order mode. However, there are certain disadvantages inherent with the use of double-ridge waveguide. For instance, rectangular double-ridge waveguide, is problematic because the presence of a plurality of corners leads to substantial signal attenuation and the peak-power-handling capability of the waveguide is generally lowered. The sharp corners are also a source of problems in certain manufacturing processes such as electroplating.

Double-ridge waveguide of the rigid type is also disadvantageous in that it requires precise alignment with the system components in order to function effectively. The lack of flexibility of rigid waveguide also poses significant difficulties in handling, storage, and shipping. Rigid waveguide is particularly difficult to install and requires accessory coupling components even if the system sections to be linked by the waveguide are slightly displaced axially. More significantly, it is difficult to economically manufacture rigid double-ridge waveguide in long lengths through continuous processing techniques.

In applications where both flexibility and broadband operation are essential, such as in many defense-related applications like airborne cabling operations, radar jamming aboard military aircraft, etc., flexible double-ridge waveguide, typically of rectangular cross-section, is used. Flexibility is provided by means of successively formed corrugations of the desired double-ridge cross-sectional shape. The manufacturing process involved in fabricating such waveguide is expensive and time consuming because the corrugations are generally non-continuous and have to be formed individually. A major disadvantage is that continuous processing is not possible and, accordingly, flexible double-ridge waveguide is commonly available in short lengths only.

Although the presence of ridges yields increased bandwidth, the other electrical characteristics of ridged waveguide are degraded in comparison with rigid non-ridged waveguide of comparable length.

The attenuation factor is increased and voltage-standing-wave-ratios (VSWRs) are degraded to the point where satisfactory performance can be achieved only in very short lengths. Inherent with the use of short lengths are problems associated with the need for coupling flanges and the associated dry air/gas leakage, potential for intermodulation, resultant VSWR degradation, and need for providing mechanical access to the coupled lengths for alignment purposes.

Consequently, there exists a need for flexible waveguide having acceptable electrical characteristics, particularly high power-handling capability, suited for use in broadband dominant-mode microwave transmission applications and which can be economically manufactured in long lengths by a continuous process.

OBJECTS OF THE INVENTION

It is a primary object of this invention to provide a waveguide of the flexible kind which is capable of dominant-mode operation across extended frequency bandwidths with relatively low signal attenuation.

It is a related object of this invention to provide a waveguide of the above kind which can be economically manufactured in long lengths according to a continuous process.

Another object of this invention is to provide a flexible waveguide of the above type which provides both relatively high peak-power-handling capability and lower signal attenuation characteristics.

It is a further object of this invention to provide an improved flexible waveguide of the type described above for which desired electrical transmission characteristics may conveniently be optimized for different broadband applications.

Other objects and advantages of the invention will be apparent from the following detailed description when taken in conjunction with the accompanying drawings.

SUMMARY OF THE INVENTION

Briefly, in accordance with the present invention, there is provided a semi-flexible double-ridge waveguide comprising a unitary metallic strip formed and welded into a tube and subsequently corrugated and formed into a special cross-sectional shape defined by controllable parameters which can be optimized to provide the waveguide with improved signal handling characteristics as compared to conventional rigid as well as flexible, double-ridge waveguide and yet permits dominant-mode operation across comparable frequency bandwidths. The present invention efficiently removes the problems associated with difficulty of installation and the bothersome requirement for precise alignment of components that is inherent to conventional rigid waveguide. As compared to flexible double-ridge waveguide, the present invention provides the much desired combination of flexibility, increased power rating, reduced attenuation and ease of manufacture of long lengths of waveguide by a continuous and relatively uncomplicated and inexpensive process.

The semi-flexible double-ridge waveguide of this invention has a special cross-section which is designed to be devoid of corners and conforms substantially to a dumbbell-shaped contour defined by a geometric equation in which specific parameters can be correlatively optimized to substantially enhance desired electrical properties of the waveguide. The semi-flexible waveguide of this type can be optimized to display electrical characteristics comparable to or better than those available with rigid double-ridge waveguide and retains the characteristics for much longer continuously formed lengths. The specially designed waveguide contour results in increased power-handling capability and improved attenuation and VSWR factors for comparable waveguide lengths.

The effects of the special waveguide shape are further enhanced, according to an embodiment of this invention, by the use of non-annular corrugations having a selected pitch which staggers the disposition of corrugation crests and troughs on opposing sides of the waveguide to such an extent as to maximize the distance between immediately opposing corrugation troughs, thereby increasing the air gap and, consequently, the power-handling capacity of the waveguide. The combination of the special dumbbell-shape having optimizable parameters with the selectively staggered corrugations effectively combines the mechanically advantageous flexibility provided by standard flexible double-ridge waveguide with the superior electrical characteristics of rigid double-ridge waveguide and increased power-handling capacity relative to conventional flexible annularly corrugated waveguide or rigid double-ridge waveguide.

BRIEF DEsCRIPTION OF THE DRAWINGS

FIG. 1(*b*) is a side view of the waveguide shown in FIG. 1 illustrating its smooth-walled nature;

DESCRIPTION OF THE PREFERRED EMBODIMENT

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of this invention as defined by the appended claims.

Figure 1A:
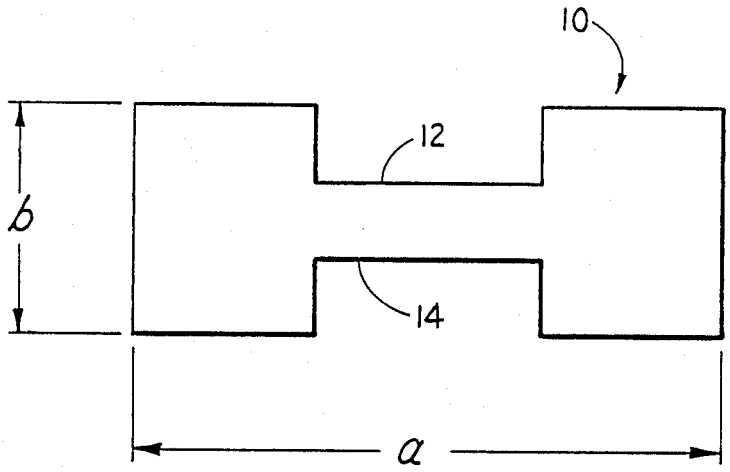
FIG. 1A PRIOR ART
FIG. 1(*a*) is a cross-sectional view of conventional double-ridge waveguide having a rectangular cross-section.

Referring now to the drawings, there is shown at FIG. 1A a cross-sectional view of conventional rectangular double-ridge waveguide 10 having a wide dimension generally designated as "a" and a narrow dimension designated as "b". As is well known, electromagnetic energy in the rectangular waveguide travels in the fundamental mode with the field intensity being uniformly distributed about the width of the waveguide, with impedance and power-handling being on the "b" dimension.

The double-ridge rectangular waveguide 10 is provided with a pair of ridges defined by oppositely disposed substantially rectangular constrictions 12, 14 extending lengthwise along the waveguide. The reduction at the center of the "b" dimension decreases the characteristic impedance and the power-handling capability of the ridge guide but substantially extends the dominant-mode operational bandwidth. With such a configuration, the electromagnetic energy is highly concentrated near the center of the cross-section.

Double-ridge waveguide of this type is commonly used with broadband transmission equipment and other applications where extended operational bandwidth and freedom from moding conditions are mandatory. However, rectangular double-ridge waveguide suffers from certain inherent disadvantages, such as higher attenuation and lower peak-power-handling capability, due to the presence of the several corners and added surface area resulting from the rectangular cross-section and the opposing constrictions which define the ridges. These corners also make certain aspects of the manufacturing process, such as electroplating, problematic.

Figure 1B:
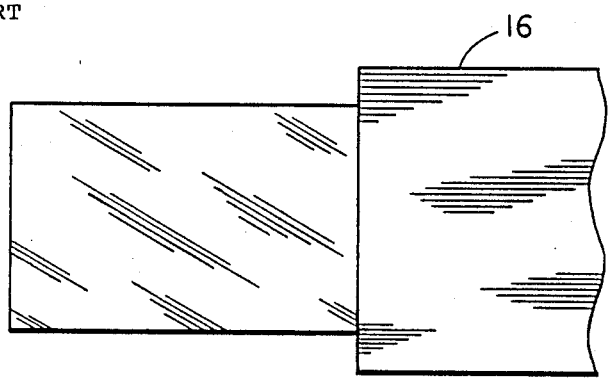
FIG. 1B PRIOR ART

As shown in FIG. 1(*b*), which is a side view of the ridged waveguide of FIG. 1(a), double-ridge waveguide is typically smooth walled and includes a protective jacket 16 over the metallic conductor constituting the guide. A major problem with smooth-walled rectangular double-ridge waveguide is that the inherent inflexibility makes routing and installation difficult and also renders the use of field-attachable flanges impractical due to the necessity for precise alignment between the components being linked.

Figure 2:
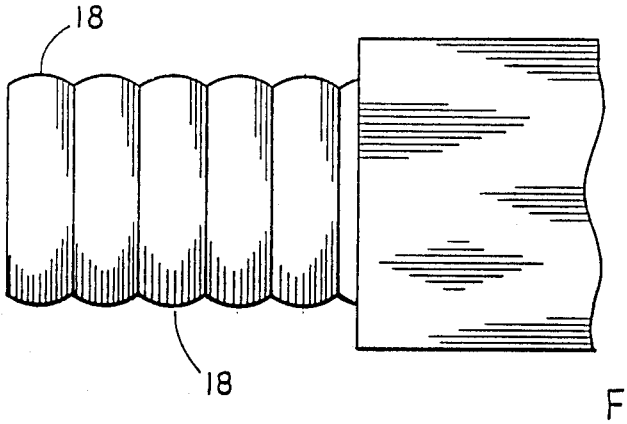
FIG. 2 is a side view of conventional waveguide having the same cross section shown in FIG. 1 but having annular corrugations.

In applications where flexibility is essential, double-ridge waveguide is rendered flexible by making the waveguide corrugated along its length while retaining the standard rectangular double-ridge cross-section. As shown in FIG. 2, flexible ridged waveguide is typically formed of annular corrugations 18 with the direction of corrugation being wholly perpendicular to the axis of the waveguide 10. The corrugations are formed by successively clamping the smooth-walled waveguide at one end and crimping the guide inwardly along its longitudinal direction to define the corrugations one at a time.

Because the annular corrugations must be individually formed, a continuous forming process cannot be used, thereby making the flexible waveguide of the type shown in FIG. 2 difficult and expensive to manufacture and also making formation of long lengths impractical. Further, the fully flexible nature of the waveguide accruing from the annular nature of the grooves dramatically increases the attenuation factor of the waveguide in use. Another problem is that the VSWR remains within acceptable limits only for restricted lengths of waveguide.

Figure 3:
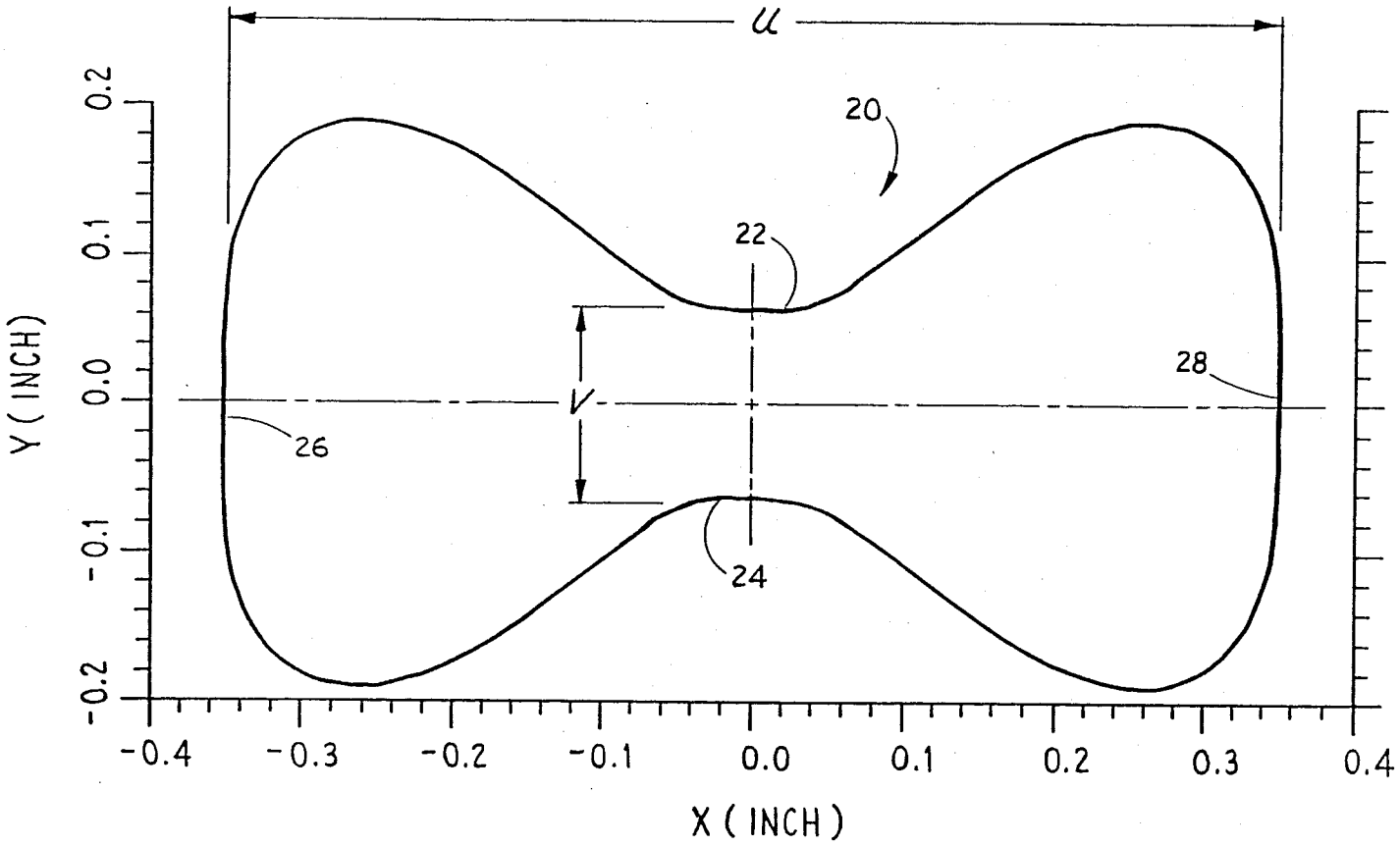
FIG. 3 is a cross-sectional view of a semi-flexible dumbbell-shaped double-ridge waveguide according to this invention.

Referring now to FIG. 3, there is shown a cross-sectional view of an improved semi-flexible double-ridge waveguide according to a preferred embodiment of the present invention. The waveguide 20 is formed of a special cross-sectional shape which is distinctly devoid of any sharp corners and has a dumbbell-like contour defined by the polar equation:

$$r^{2p}-2ar^{p}\cos 2\Theta+a^{2}=b^{2} \quad (1)$$

where "r" is the radical distance between any given point on the contour and the point of origin, and "Θ" is the angle between the major axis and the radial line along which that point is defined on the contour.

In equation (1), the constants "a" and "b" are defined in terms of the major and minor axes "u", "v", respectively, of the contour as below:

$$a=\frac{(u^{p}-v^{p})}{2^{p+1}} \quad (2)$$

and $$b=\frac{(u^{p}+v^{p})}{2^{p+1}} \quad (3)$$

where "u", "v", and "p" are selectable variables. The dumbbell shape essentially corresponds to that of a rectangular waveguide having oppositely disposed ridges 22, 24 which are not of the rectangular cross-sectional shape shown in FIGS. 1A, 1B and 2 but instead are of a substantially bell-shaped cross-section which extends to generally convex ends 26, 28 of the waveguide cross-section defined about the major axis.

In the waveguide cross-section shown in FIG. 3, it should be noted that the polar equation (1) defines the contour in such a way that the upturned ends of the bell-shaped ridges smoothly merge with the cross-sectional ends of the waveguide, thereby avoiding the presence of any corners or abrupt protrusions. The contour of FIG. 3 represents the cross-sectional shape of the waveguide 20 according to a preferred embodiment where the parameters "u", "v" and "p" are selected to be 0.702" , 0.128", and 3.40, respectively, based on a dominant-mode operational bandwidth of 7.5–18.0 GHz.

Figure 4:
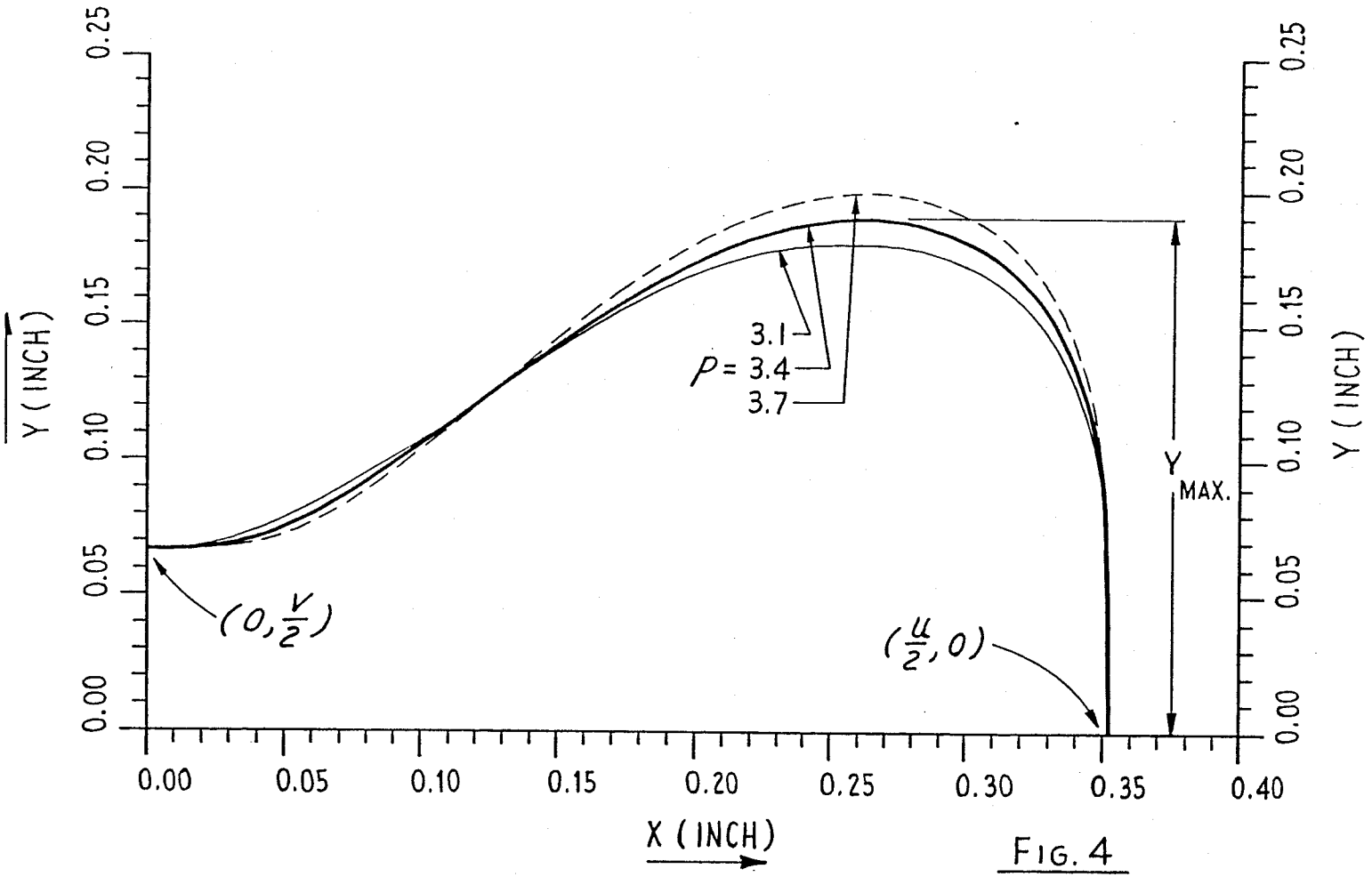
FIG. 4 is a representation of the variation in waveguide contour in correspondence with variation in the parameter "p"

A family of curves of the type shown in FIG. 3 can be generated by maintaining the parameters "u" and "v" constant, while varying the parameter "p". Such a family of curves, all having identical major and minor axes, is shown in FIG. 4, which is an illustration of how a variation in the parameter "p", while keeping "u" and "v" constant (at 0.702" and 0.128", respectively), affects the cross-sectional shape of the waveguide contour. More specifically, increasing values of "p" increase the extent to which the waveguide contour strays away from the minor axis before merging with the cross-sectional ends. FIG. 4 shows the variation only along the first quadrant of the overall contour cross-section; it will be apparent that a similar variation in shape also applies to the remaining three quadrants.

Figure 5:
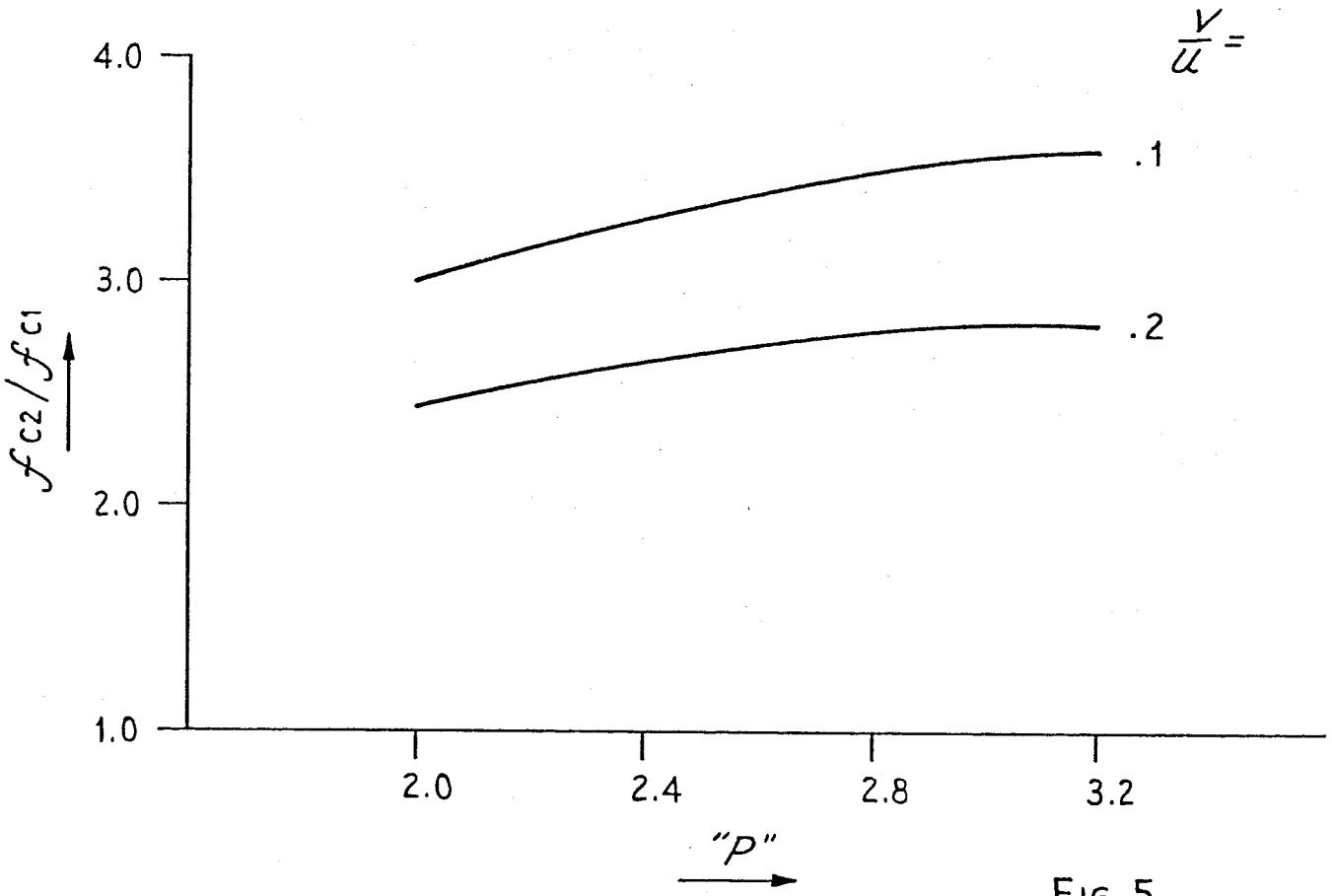
FIG. 5 is a graphical representation of the bandwidth variation of the waveguide of FIG. 3 relative to the parameter "p"

Referring now to FIG. 5, there is shown a graphical illustration of the increase in bandwidth realized by the dumbbell-shaped waveguide of FIGS. 3 and 4. Shown therein is a pair of graphs representing the variation in bandwidth of the waveguide with increasing values of the parameter "p" for different ratios of the length of the major and minor axes "u", "v", respectively. In plotting the curves shown in FIG. 5, the waveguide bandwidth is defined as the ratio of the cutoff frequency ($F_{c2}$) of the modified $TE_{20}$ mode to the cut-off frequency ($F_{c1}$) of the modified $TE_{10}$ mode. As evident from the curves, any increase in the value of the parameter "p" brings about an increase in bandwidth defined by the ratio $F_{c2}/F_{c1}$, with the range of bandwidth being inversely proportional to the selected aspect ratio (v/u) for the contour.

In order for the desired dumbbell-shaped waveguide contour to be adequately defined, equation (1) must be subject to two constraints:

(i) the constant "b" must be greater than the constant "a"-otherwise the cross-section will be split into two parts which are symmetric about the y-axis; and (ii) the parameter "p" must have a value greater than two (2) in order to achieve the above-described increase in bandwidth.

Provided the above conditions are met, it is possible for the waveguide contour to be optimized conveniently by considering the change in electrical characteristics produced by variations in the parameters "u", "v" and "p" and determining, preferably through some form of computer-based approximately technique, the range of values for these parameters which provides the largest possible dominant-mode operational bandwidth and the least amount of signal attenuation. This determination can be supplemented by actually measuring the desired electrical characteristics to determine the optimum value or range of values of the parameters required to define a waveguide contour which is optimized for the desired bandwidth of dominant-mode operation, selected attenuation characteristics, etc.

The calculation of the cutoff frequencies of the first two modes, namely the modified $TE_{10}$ and $TE_{20}$ modes, for defining the operational bandwidth and the accompanying attenuation can be performed conveniently by employing one of several computer techniques, such as polynomial approximation or finite element analysis, which are known in the industry for analyzing waveguide shapes of arbitrary cross-sections. One exemplary technique is described by R. M. Bulley in a paper entitled "Analysis of the arbitrarily shaped waveguide by polynomial approximation", as published in *IEEE Transactions on Microwave Theory and Techniques* Vol. MTT-18, pp. 1022–1028, Dec. 1970.

Figure 6:
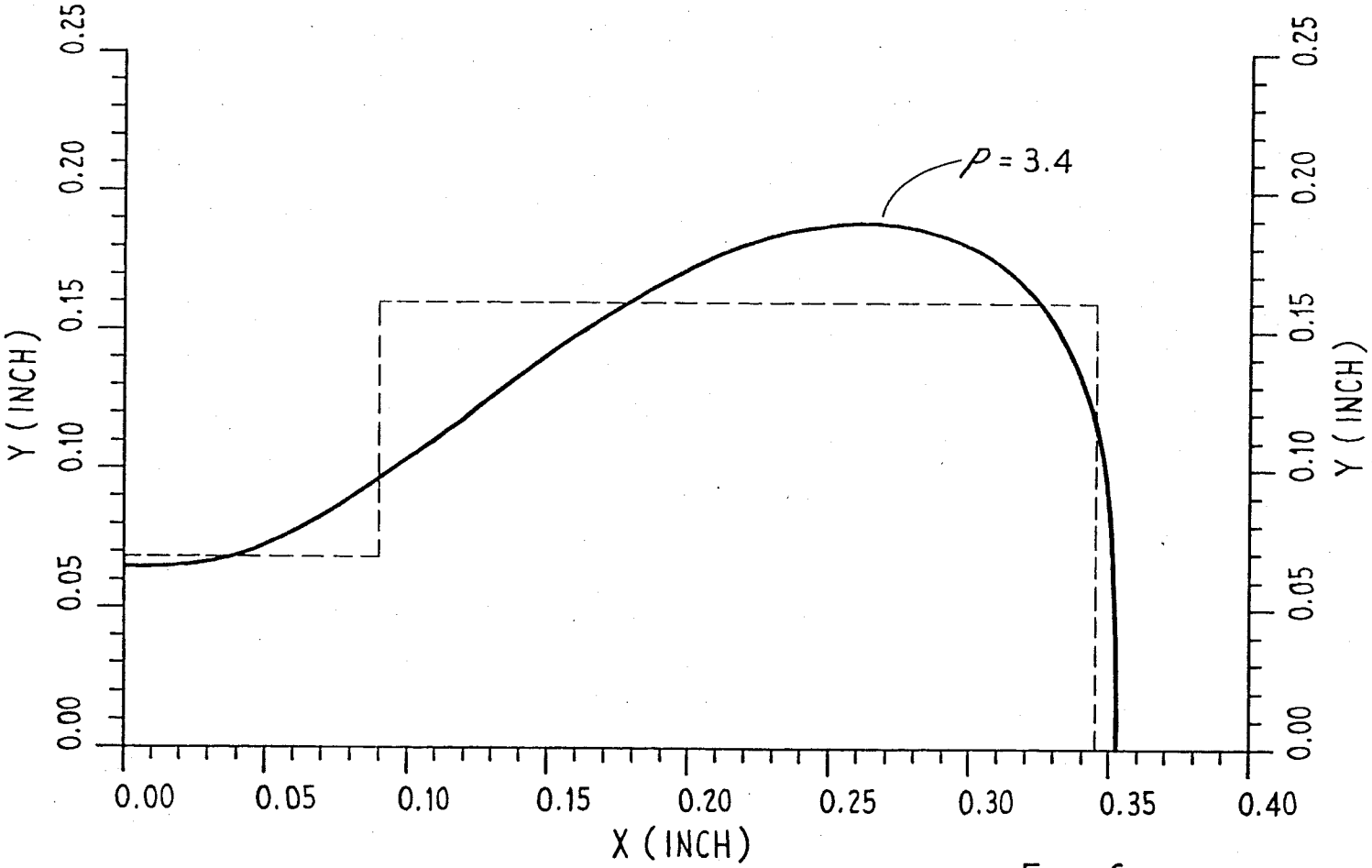
FIG. 6 is a graphical comparison of the waveguide of the type shown in FIG. 3 to conventional rectangular double-ridge waveguide.

According to a preferred embodiment of this invention, a dumbbell-shaped waveguide was optimized for the 7.5–18.0 GHz frequency bandwidth commonly used nowadays for defense-related tele-communication purposes. Such an optimized waveguide is illustrated at FIG. 6, which shows a graphical comparison between the dumbbell-shaped contour based on equation (1) for the case where "p"=3.4 and defined for a 7.5–18.0 GHz dominant-mode bandwidth using the polynomial approximation technique, and the corresponding first quadrant contour (represented by a dashed line) of a conventional double-ridge waveguide having a rectangular cross-section.

Figure 7:
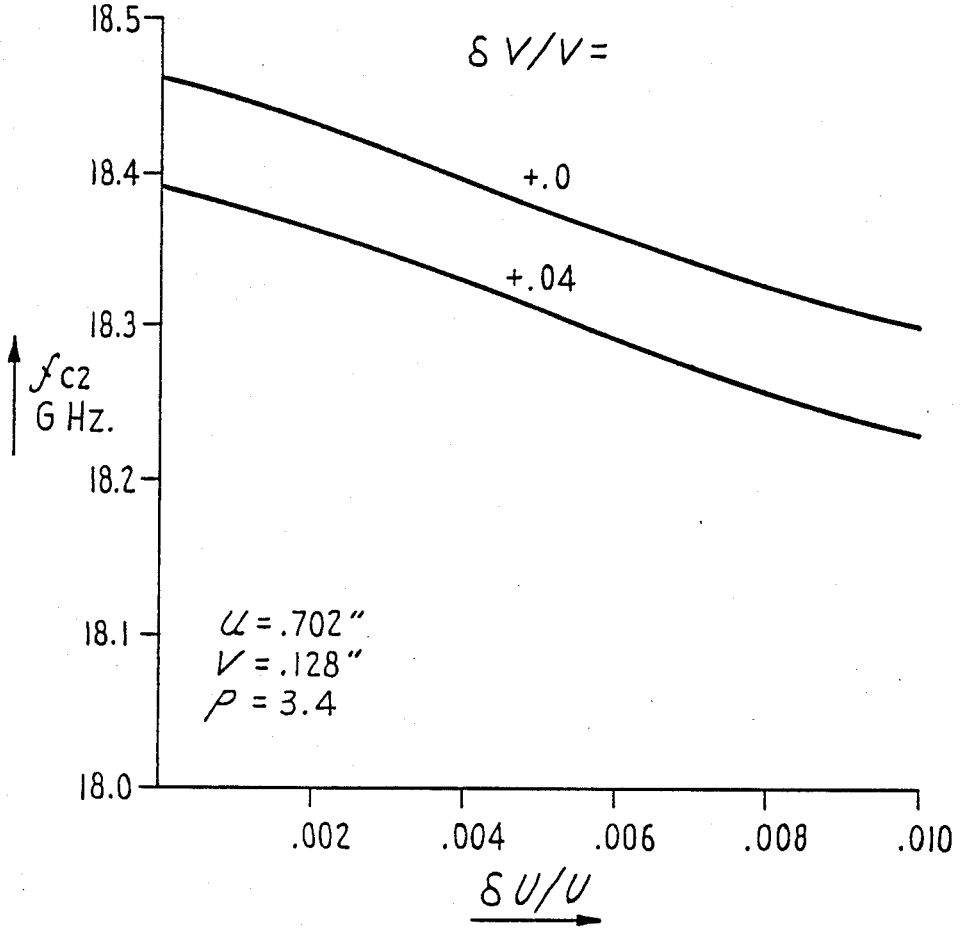
FIG. 7 is a graphical illustration of the correlation between the cut-off frequency of the first higher-order mode and the parameters "u" and "v"

FIG. 7 is a graphical illustration of the correlation between the length of the major and minor axes "u" and "v", respectively, and the cut-off frequency of the first higher-order mode. As shown therein, the cut-off frequency $F_{c2}$ gradually decreases with increasing values of "u" when the parameter "v" is maintained constant. Two such correlation graphs are shown for incremental differences in the parameter "u" being equal to 0.0 and 0.04.

Figure 8:
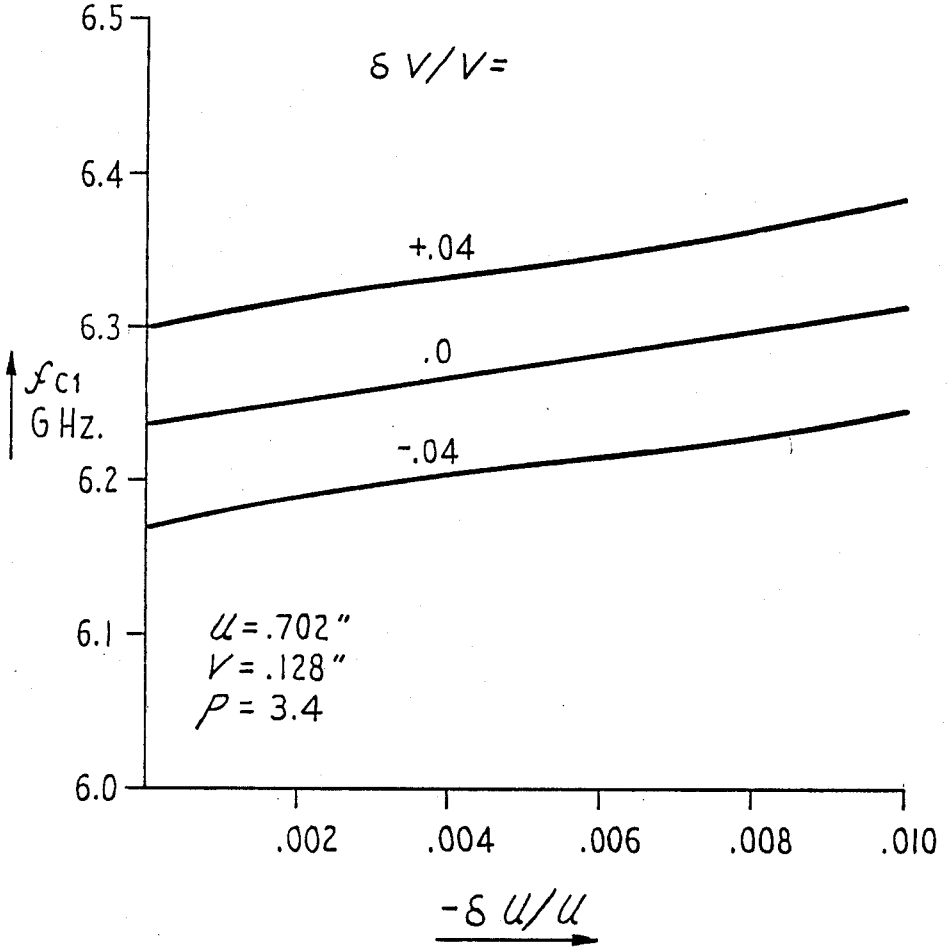
FIG. 8 is a graphical illustration showing the correlation between the cut-off frequency of the dominant mode and the parameters "u" and "v"

FIG. 8 is a similar graphical illustration showing the correlation between the dominant mode cut-off frequency and incremental differences in the length of the major axis, i.e., the parameter "u", while maintaining the length of the minor axis, i.e., the parameter "v", at a predetermined constant value. Three such correlation curves are shown in FIG. 8 for predetermined constant values of 0.0, +0.04 and −0.04 of the parameter "v".

It will be obvious from the foregoing that the primary parameters of the polar equation defining the dumbbell-shaped contour shown in FIGS. 3 and 4 can be conveniently optimized to achieve desired electrical performance characteristics. Relevant details on applying such techniques to calculation of waveguide parameters, as well as the correlation between the major and minor axes and waveguide performance characteristics such as dominant-mode bandwidth and attenuation, are well known to those skilled in the art and, accordingly, will not be described in detail herein.

For purposes of this description, it suffices to state that the parameters "u", "v" and "p" of the semi-flexible waveguide defined by equation (1) can, according to this invention, be controllably varied to realize significantly improved dominantmode operational frequency bandwidth and reduced attenuation factor compared to that of standard rectangular or circular waveguide. In fact, it has experimentally been confirmed that such a waveguide can be optimized to provide operational dominant-mode bandwidths comparable to or better than that of standard ridge waveguide while, at the same time, having an attenuation factor significantly lower than that of any commercially available double-ridge waveguide.

Figure 9:
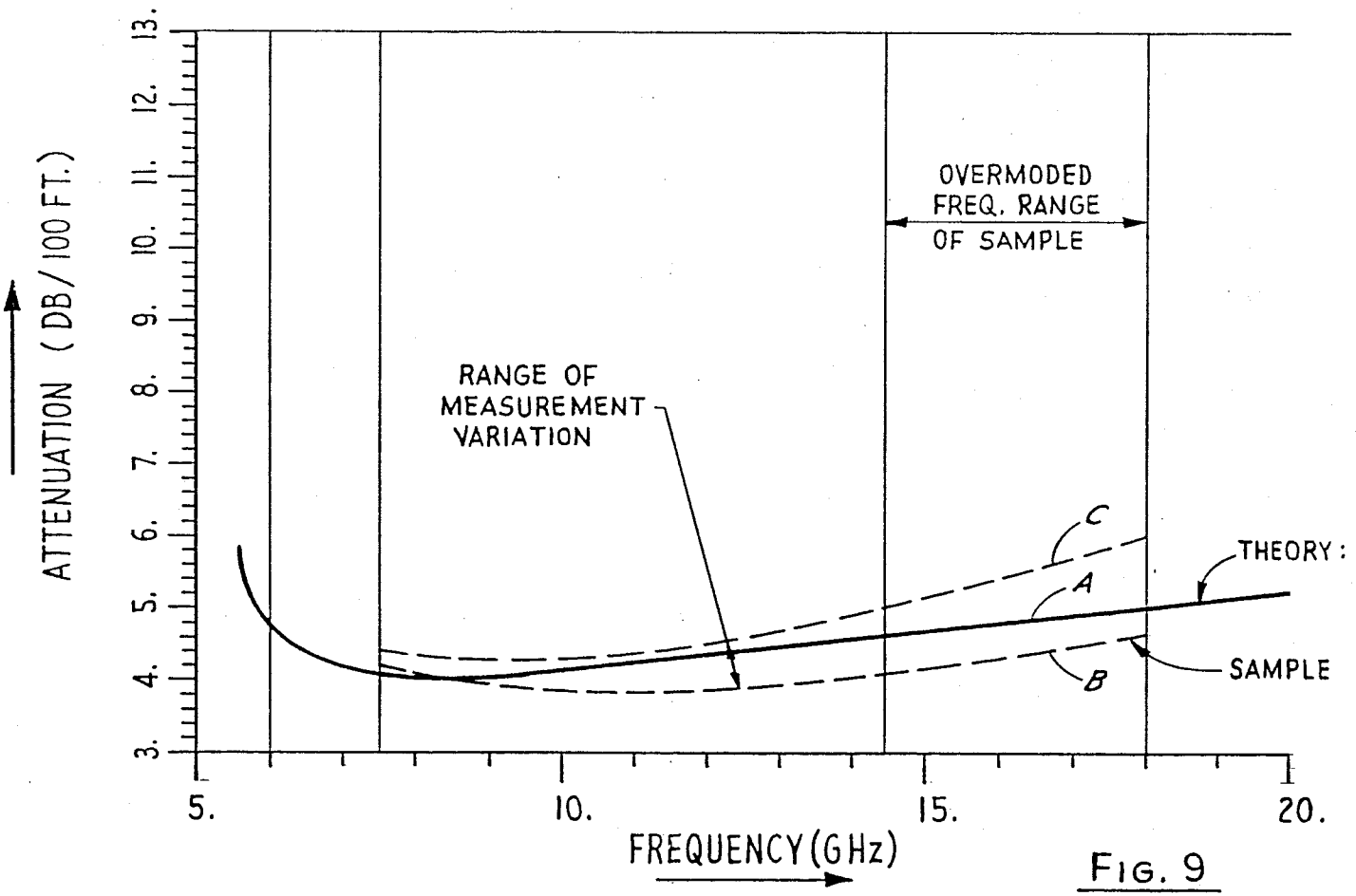
FIG. 9 is a graphical illustration of the attenuation associated with the semi-flexible waveguide of this invention.

FIG. 9 shows graphical representations of curves based on theoretical and experimental data reflecting the attenuation associated with the semi-flexible waveguide of this invention and the variation in attenuation across the desired frequency bandwidth. The waveguide used for these measurements was optimized for operation across a frequency bandwidth extending between 6.0–14.4 GHz. In FIG. 9, the curve A represents the theoretically calculated attenuation versus frequency response for the semi-flexible waveguide, as determined on the basis of polynomial approximation or like techniques. The theoretical attenuation remains substantially within the range of 4.0–5.5 dBs/100 ft. across the frequency band of interest. As compared to this, the experimentally measured attenuation, as represented by curves B and C, remains substantially within the ranges of 4.0–5.0 5.0 dBs/100 ft. and 4.0–6.0 dBs/100 ft., respectively, at the lower and upper ends of the measurement scale.

Theoretical calculations based on the waveguide of FIGS. 3 and 9, as optimized for the frequency range of 7.5–18.0 GHz, confirmed an attenuation of less than 7 dBs/100 ft. which is a significant improvement over the attenuation factors of 10.0–12.0 dBs/100 ft. and 20.0–30.0 dBs/100 ft. presently associated with commercially available rigid and flexible double-ridge waveguide, respectively.

Figure 10:
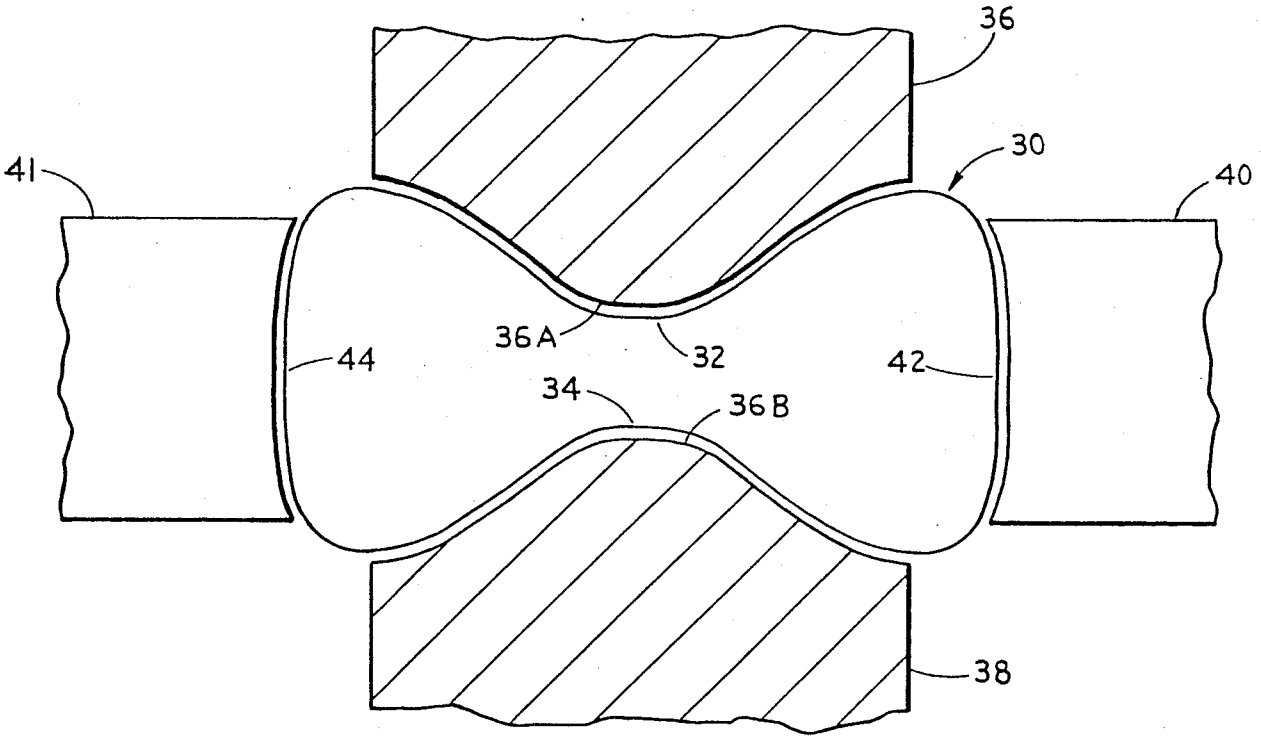
FIG. 10 is a sectional side view of a shaping wheel arrangement used to generate the dumbbell-shaped cross-sectional contour shown in FIG. 3.

Referring now to FIG. 10, there is shown a cross-sectional view of a preferred arrangement for imparting the special dumbbell-shaped contour to form the semi-flexible waveguide of the shape shown in FIG. 3. As shown therein, the cross-section of the waveguide 30 is defined by the oppositely disposed bell-shaped ridge sections 32, 34 and the generally convex end sections 42 and 44 which effectively link the ridges to form the overall dumbbell-shaped contour defined by polar equation (1) using selected values for parameters "u", "v" and "p". As described above, the choice of these parameters is based upon the desired dominant-mode bandwidth and minimized attenuation, as most advantageously determined by computer-based polynomial approximation, finite element analysis or other like technique.

Once the optimum values of the parameters "u", "v" and "p" have been determined, the waveguide contour is formed from a continuous length of corrugated circular tube by means of a pair of ridge wheels 36, 38 which have driving faces 36A, 36B possessing a shape substantially corresponding, according to a converse relationship, to the bell-shaped contour of the waveguide ridges 32, 34. The ridge wheels are simultaneously brought into rotating contact on diametrically opposite external faces of the tubular waveguide as the waveguide is continuously moved across the rotating ridge wheels in a transverse direction. At the same time, a pair of diametrically opposed support surfaces 40, 41 having concave faces generally corresponding, according to a converse relationship, to the shape of the convex end sections 42, 44 are brought into supporting contact with the end sections. The simultaneous positive driving impact of the ridge wheels 36, 38 on diametrically opposite surfaces of the waveguide forms the two bell-shaped ridges 32, 34, and the support provided by the concave surfaces 40, 41 on the remaining opposite surfaces of the waveguide prevents any uneven expansion of the waveguide under the driving impact of the ridge wheels. Thus, the ridge wheels and the support surfaces, in conjunction with each other, generate the overall dumbbell-shaped contour defined by the optimized polar equation (1).

In order to increase the power handling capability of the waveguide as well as to provide flexibility, the waveguide of FIG. 3 is rendered semi-flexible by the use of continuously linked corrugations which allow a certain degree of flexibility without rendering the waveguide completely flexible like conventional flexible waveguide having discrete annular corrugations. According to a preferred embodiment of this invention, the waveguide of the desired cross-sectional shape is formed with helical corrugations which provide only a restricted amount of flexibility. In effect, such a waveguide is truly "semi-flexible" and has distinct advantages over both rigid double-ridge waveguide and flexible double-ridge waveguide.

More specifically, the semi-flexible waveguide is significantly easier to be routed and installed in confined areas and flexible enough to be adapted to minor length adjustments which are essential to accommodate dimensional tolerances both in the waveguide itself and in the area where the waveguide is to be installed. At the same time, the restricted flexibility also keeps signal attenuation down and makes practical the use of waveguide lengths substantially longer than would be possible with completely flexible waveguide.

Flexibility of double-ridge waveguide has conventionally been achieved by using annular corrugations which are discrete and non-continuous. Such waveguide is typically manufactured by forming a tube from a strip of conductive metal (typically copper or aluminum), welding the tube and shaping it to approximate rectangularity, and forming annular corrugations thereupon by clamping the smooth-walled waveguide at one end and successively crimping the waveguide inwardly along its longitudinal direction toward the clamped end to define the corrugations one at a time.

Figure 11A:
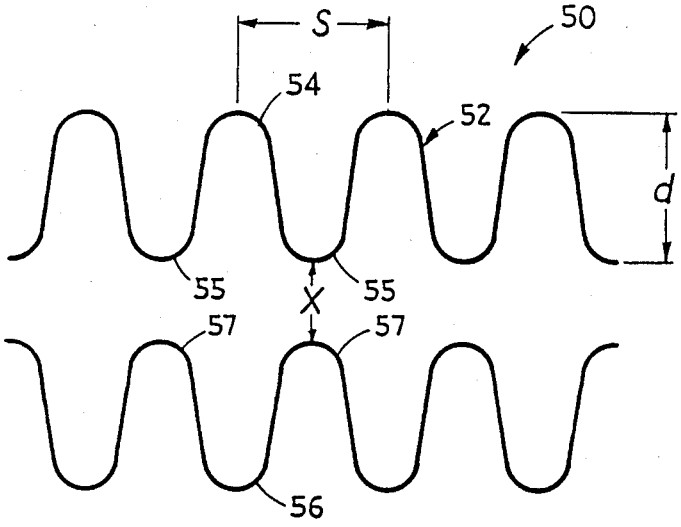
FIG. 11A is a cross-sectional view of conventional annularly corrugated ridged waveguide.

In order to make the waveguide completely flexible, the annular corrugations are relatively deep and close-spaced. A cross-sectional view of conventional annularly corrugated ridged waveguide is illustrated at FIG. 11A. As shown therein, the waveguide 50 has annular corrugations 52 spaced apart by a distance "S" (the pitch) and extending to a depth "d" defined by the distance between successive crests 54 and troughs 55 of the corrugations. Because the corrugations are annularly formed, the corrugation crests 54 on one wall of the waveguide are disposed diametrically opposite the corrugation crests 56 on the other wall of the waveguide and vice versa. The result is that the breakdown air gap, which defines the power-handling capability of the waveguide and which is a function of the minimum distance between opposing internal surfaces of the waveguide, is restricted for a given internal waveguide diameter. In FIG. 11A, for instance, the annular corrugations are spaced apart by a pitch distance of "S" which is comparable to the corrugation depth "d" and the ratio of corrugation depth to pitch is typically 0.8 or more. The air gap distance, as defined by the space between opposing corrugation troughs 55 and 57 is designated as "X" in FIG. 11A. Even if the annular corrugations were to be provided in the form of spaced-apart groups in order to restrict flexibility, the breakdown air gap and, hence, the maximum power rating of the waveguide remains restricted by the distance "x".

Figure 11B:
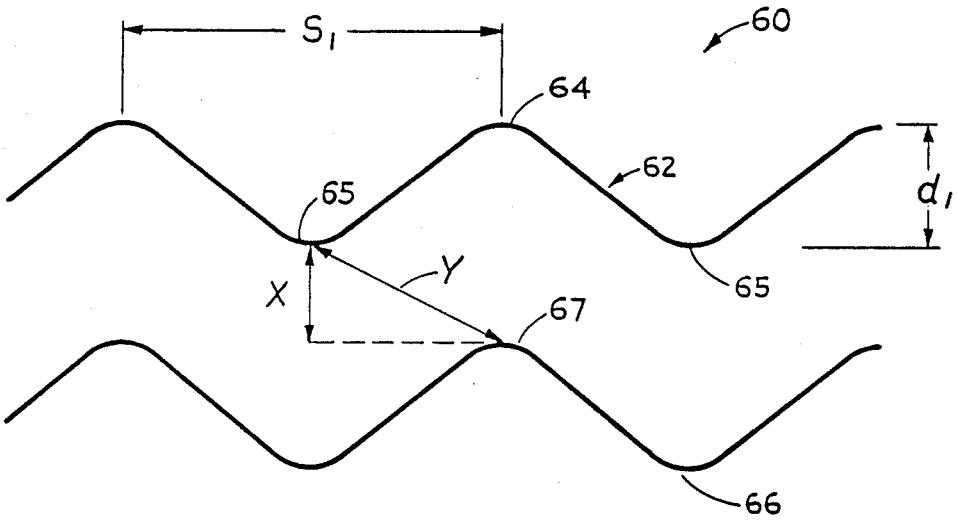
FIG. 11B is an illustration of the staggered disposition of corrugation crests and troughs, according to a preferred embodiment of this invention.

In accordance with a feature of this invention, the power-handling capability of waveguide having the dumbbell-shaped contour of FIG. 3 is increased by using continuous non-annular corrugations which are relatively widely spaced compared to the corrugation depth, as shown in FIG. 11B. It will be apparent that the dumbbell-shaped contour generated on the basis of polar equation 1 is devoid of the sharp edges characteristic of conventional rectangular double-ridge waveguide; the rounded edges (see FIG. 3) avoid the excessive power loss resulting from obstructions presented by sharp corners in the waveguide cavity. The power rating of the waveguide is further increased by the use of corrugations which are helically configured in such a way that the corrugation crests and trouqhs on one wall of the waveguide are staggered relative to those on the opposite wall. As shown in FIG. 11B, the waveguide 60 is formed of helical corrugations 62 which are spaced apart at a pitch distance "$S_1$", which is substantially larger than the corrugation depth "$d_1$". According to a preferred embodiment, for a waveguide optimized for operation within a band width of 7.5–18.0 GHz, the pitch "$S_1$" was selected to be about 0.18" and the depth "$d_1$" was selected to be about 0.04" so that the depth-to-pitch ratio was about 0.22.

The helical nature of the corrugations effectively staggers the corrugation crests 64 and troughs 65 on one wall of the waveguide relative to those on the opposing wall. The result is that, in the waveguide of FIG. 11B, the air gap distance "Y" is defined between helical corrugation troughs 65 on the top wall of the waveguide 60 and the corresponding troughs 67 on the bottom wall and is larger than the distance "X" that would exist if the corrugations were to be annular. This increase in air gap distance is significant in the case of double-ridge waveguide of the type shown in FIG. 3 because the constrictions defined by the bell-shaped ridges intrinsically reduce the air gap substantially to the point where the air gap becomes comparable to the pitch of the corrugations. Under such conditions, even a small increase in air gap resulting from the expansion of the distance between opposing corrugation troughs and crests can produce a noticeable increase in the maximum power rating of the waveguide.

It should be noted that FIG. 11B represents the case where the relative staggering of opposing corrugations is by the maximum extent possible between the opposite walls of the waveguide. More specifically, in FIG. 11B, the staggering is such that the corrugation troughs 65 on the top wall of the waveguide 60 are disposed immediately opposite the corrugation crests 66 on the bottom wall. However, the breakdown air gap is increased even if the corrugations are staggered to a lesser extent than that shown in FIG. 11B so that corrugations crests on one wall do not directly face the corrugation troughs on the opposite wall, but are merely displaced relative to each other. It will be apparent that any staggering of corrugations relative to the disposition illustrated in FIG. 11A realizes a distance "y" which is greater than the distance "x", thereby increasing the waveguide air gap and power-handling capability.

Thus, the combined use of an decreased ratio of corrugation depth to corrugation pitch and the helical staggering of corrugation crests and troughs in a waveguide having the optimizable dumbbell-shaped cross-section realizes the much desired combination of flexibility and improved electrical characteristics, including increased power-handling capability.

The helically corrugated waveguide having the dumbbell-shaped cross-section, according to the present invention, is conveniently manufactured in long lengths by the use of a continuous process wherein the helically corrugated waveguide is first formed by the use of continuous rotating contact between an appropriately shaped corrugating die or tool and the external surface of waveguide formed by folding and longitudinally welding a strip of metal into a substantially circular tube. The tube is continuously advanced and the corrugating tool is moved wholly transversely in proper synchronism with the advancing motion of the tube. The helically corrugated waveguide is then provided with the dumbbell-shaped cross-section using the procedure described above for using the shaping wheel arrangement of FIG. 10 to impart the shape defined by equation (1).

What is claimed is:

1. A semi-flexible, double-ridge waveguide having reduced attenuation and increased power-handling capability for a given bandwidth, said waveguide comprising a continuous length of corrugated tube having a substantially dumbbell-shaped cross-sectional contour defined about major and minor axes "u" and "v", respectively, by a polar equation relating variables 'r' and 'Θ' according to the relationship $$r^{2p}-2ar^p\cos 2\Theta+a^2=b^2,$$

wherein parameter $$\text{"}a\text{"} = \frac{(u^p - v^p)}{2^{p+1}}$$

and parameter $$\text{"}b\text{"} = \frac{(u^p + v^p)}{2^{p+1}},$$

said parameter "b" being greater than said parameter "a"; said exponent "p" has a value greater than two; "r" and "Θ" are variables, "r" being the radial distance between any given point on said contour and the point of origin and "Θ" being the angle between the major axis and the radial line along which said given point is defined on said contour, and wherein said corrugated tube includes helical corrugations having a pitch "S" and depth "d", said corrugations having crests and troughs disposed in a staggered configuration such that corrugation crests and troughs on one wall of the waveguide are shifted relative to corresponding corrugation crests and troughs on the opposing wall of the waveguide, thereby increasing the air gap between opposing walls of the waveguide.

2. The waveguide as defined in claim 1 wherein the corrugations are characterized by a depth-to-pitch ratio (d/S) of less than 0.5

3. The waveguide a defined in claim 1 wherein said parameters "u", "v" and "p" are selected in such a manner as to optimize the bandwidth and attenuation of said waveguide for a given length, and wherein said parameter "p" is selected to be within the range of 2.6–4.0.

4. A double-ridge waveguide having a cross-sectional contour defined about major and minor axes u and v, respectively, by the polar equation $$r^{2p}-2ar^p\cos 2\Theta+a^2=b^2$$

where r and Θ are variables, r being the radial distance between any given point on said contour and the point of origin and Θ being the angle between the major axis and the radial line along which said given point is defined on said contour, a and b are constants defined in terms of said major and minor axes u and v as $$a = \frac{u^p - v^p}{2^{p+1}} \quad b = \frac{u^p + v^p}{2^{p+1}},$$

and the exponent p has a value greater than two.

5. The waveguide of claim 4 wherein the exponent p has a value within the range from about 2.6 to about 4.0.

6. The waveguide as set forth in claim 4 further comprising a continuous length of corrugated tube having helical corrugations with a pitch S and depth d, said corrugations having crests and troughs disposed in a staggered configuration such that corrugation crests and troughs on one wall of the waveguide are shifted relative to corresponding corrugation crests and troughs on the opposing wall of the waveguide, thereby increasing the air gap between opposing walls of the waveguide.

7. The waveguide as set forth in claim 6 wherein the corrugations are characterized by a depth-to-pitch ratio (d/S) of less than 0.5.

8. A method of increasing the power-handling capability of a double-ridge waveguide for a given bandwidth or increasing the waveguide bandwidth for a given power-handling capacity by shaping the waveguide to have a substantially dumbbell-shaped cross-sectional contour defined about major and minor axes u and v, respectively, by the polar equation $$r^{2P}-2ar^P\cos 2\Theta+a^2=b^2$$

where r and Θ are variables, r being the radial distance between any given point on said contour and the point of origin and Θ being the angle between the major axis and the radial line along which said given point is defined on said contour, a and b are constants defined in terms of said major and minor axes u and v as $$a = \frac{u^p - v^p}{2^{p+1}} \quad b = \frac{u^p + v^p}{2^{p+1}},$$

and the exponent p has a value greater than two, said parameters u, v and p being selected such as to optimize the bandwidth and attenuation of said waveguide for a given length.

9. The method as set forth in claim 8 wherein the exponent p has a value within the range from about 2.6 to about 4.0.

10. The method as set forth in claim 8 wherein the power-handling capability of said waveguide is further increased by forming said waveguide of a corrugated tube having helical corrugations with a pitch S and depth d, said corrugations having crests and troughs disposed in a staggered configuration such that corrugation crests and troughs on one wall of the waveguide are shifted relative to corresponding corrugation crests and troughs on the opposing wall of the waveguide, thereby increasing the air gap between opposing walls of the waveguide.

11. The method as set forth in claim 10 wherein the corrugations are characterized by a depth-to-pitch ratio (d/S) of less than 0.5.

* * * * *